United States Patent [19]

Odnoral et al.

[11] Patent Number: 4,985,735

[45] Date of Patent: Jan. 15, 1991

[54] ELECTRIC DRIVE WITH MANUAL DOUBLER

[76] Inventors: Alexandr P. Odnoral, ulitsa Krasny Oktyabr, 3, kv. 34, Moskovskaya oblast, Dedovsk; Nikolai S. Tolmachev, ulitsa Lenina, 1, kv. 211; Vladimir A. Tjutkin, ulitsa Lenina, 13, kv. 31, both of Moskovskaya oblast, Istra, all of U.S.S.R.

[21] Appl. No.: 449,879

[22] PCT Filed: Apr. 22, 1988

[86] PCT No.: PCT/SU88/00096

§ 371 Date: Jan. 10, 1990

§ 102(e) Date: Jan. 10, 1990

[87] PCT Pub. No.: WO89/10213

PCT Pub. Date: Nov. 2, 1989

[51] Int. Cl.[5] ..... H01F 7/06; H01F 7/20; B08B 7/02; B06B 1/04

[52] U.S. Cl. ..... 335/299; 335/296; 361/139; 134/1

[58] Field of Search ..... 335/296, 299; 361/139; 134/1

[56] References Cited

U.S. PATENT DOCUMENTS 4,838,287 6/1989 Matsui et al. ..... 134/1

FOREIGN PATENT DOCUMENTS 875198 10/1981 U.S.S.R. .
918220 4/1982 U.S.S.R. .
1126339 11/1984 U.S.S.R. .

*Primary Examiner*—Steven L. Stephan
*Assistant Examiner*—C. LaBalle
*Attorney, Agent, or Firm*—Burgess, Ryan & Wayne

[57] ABSTRACT

An apparatus for cleaning surfaces from substances adhered thereto comprises a multilayer electromagnet coil (1), a source (3) of pulse current, a paramagnetic plate (4) disposed between the surface (5) being cleaned and the electromagnet coil (1). The number n of layers (8) in the coil (1) is within two and five, each such layer having the form of a current-conducting helical bar (7) of rectangular cross section. The layers (8) are arranged in parallel planes and are connected in an aiding connection. With respect to two-layer, three-layer, four-layer, and five-layer electromagnetic coils (1) there is a predetermined dependence of the number W of coil turns (9) in each layer (8) on the optimum number $W_1$ of turns (9), and the height h of the current-conducting bar (7) on the equivalent depth Δ of penetration on the magnetic field into the metal of the electromagnetic coil (1).

1 Claim, 3 Drawing Sheets

ELECTRIC DRIVE WITH MANUAL DOUBLER

FIELD OF THE INVENTION

This invention relates generally to devices for cleaning and preventing contamination of surfaces through vibration, and more specifically to an apparatus for cleaning a surface from substances adhering thereto.

PRIOR ART

There is known an apparatus for cleaning a surface from impurities (cf., SU, A, 875, 198), comprising a flat electromagnet coil, a paramagnetic plate, a rod and a pusher for transmitting pulses from the electromagnet coil to the surface being cleaned, and an additional paramagnnetic plate disposed at the opposite face of the electromagnet coil. The first paramagnetic plate is connected to the surface being cleaned through the pusher, whereas the additional paramagnetic plate is connected to the surface being cleaned through the rod.

However, this apparatus fails to produce a sufficiently strong pulse force, because the electromagnet coil has the form of a single-layer spiral with a random number of turns. In addition, with the flat arrangement of the electromagnet coil the depth of penetration of the magnetic field into the metal of the electromagnet coil can substantially exceed the height of the current-conducting bar of the spiral, which affects electromagnetic coupling of the coil with the paramagnetic plates. This apparatus therefore provides an insufficiently strong impulse of force applied to the surface being cleaned to result in low surface cleaning efficiency.

There is also known an apparatus for cleaning a surface from substances adhering thereto (cf., SU, 918, 220) comprising an electromagnet coil, a source of pulse current connected to the electromagnet coil, a paramagnetic plate fabricated from a material of high electrical conductivity positioned between an end face of the electromagnet coil and the surface being cleaned, a spring-biased rod, and a platen. The apparatus is provided with an additional paramagnetic plate fabricated from a material of high electrical conductivity, arranged at the opposite side of the electromagnet coil, resiliently linked therewith and with the main paramagnetic plate through the spring-biased rod, and a shell connected to the additional paramagnetic plate by way of a transmission means and disposed coaxially with the electromagnet coil. The paramagnetic plate is secured at the bottom part of the shell having the transmission means mounted at its side surface. The shell is connected to the platen through resilient elements, and is arranged so as to move between the electromagnet coil and shell. This apparatus has low efficiency of converting the energy of the source of pulse current into mechanical energy for cleaning the surface due to that the electromagnet coil is single-layer and has a random number of coil turns, whereby the impulse of force applied to the surface being cleaned lacks the required strength. This in turn makes cleaning of surfaces from substances adhered thereto less efficient. In view of the aforedescribed, the prior art apparatus has a rather low surface cleaning efficiency.

SUMMARY OF THE INVENTION

The invention aims at providing an apparatus for cleaning a surface from substances tending to adhere thereto having such a structural arrangement as to enable, through increasing the impulse of force applied to the surface being cleaned, to attain a more efficient conversion of the energy generated by a source of pulse current to mechanical energy used for cleaning the surface, and thereby make the surface cleaning more efficient.

The aims of the invention are attained by that in an apparatus for cleaning a surface from substances adhered thereto comprising an electromagnet coil, a source of pulse current connected to the electromagnet coil, a paramagnetic plate fabricated from a highly electroconductive material arranged between the surface being cleaned and end face of the electromagnet coil, according to the invention, the electromagnet coil is multilayer, the number n of layers ranging from two to five, each layer having the form of a helical current conducting bar of rectangular cross section, the layers of the electromagnet coil resting in parallel planes and connected in an aiding connection, the number W of coil turns in each layer for a two-layer electromagnet coil ranging from $0.4W_1$ to $1.1W_1$, whereas the height h of the current-conducting bar ranges from $\Delta$ to $1.5\Delta$, for a three-layer electromagnet coil the number W of coil turns in each layer ranging from $0.35W_1$ to $0.9W_1$, whereas the height h of the current-conducting bar ranges within from $0.8\Delta$ to $\Delta$, for a four-layer electromagnet coil the number W of coil turns in eavh layer ranging from $0.32W_1$ to $0.75W_1$, whereas the height h of the current-conducting bar ranges from $0,75\Delta$ to $0.9\Delta$, and for a five-layer electromagnet coil the number W of coil turns in each layer ranging from $0.3W_1$, whereas the height h of the current-conducting bar is within a range from $0.7\Delta$ to $0.8\Delta$, where $W_1$ is the optimum number of coil turns, and $\Delta$ is the equivalent depth of penetration of the magnetic field into the metal of the electromagnet coil.

The proposed apparatus for cleaning a surface from substances adhered thereto makes it possible to increase the impulse of mechanical forces applied to the surface being cleaned, reduce the amount of electrie power consumed for the cleaning process, automate the cleaning process, dispense with manual operations, and increase the service life of the equipment cleaned by the apparatus. The invention also ensures a higher efficiency of cleaning a surface from substances adhered thereto.

BRIEF DESCRIPTION OF THE DRAWINGS

The invention will now be described in greater detail with reference to a preferred embodiment thereof taken in conjunction with the accompanying drawings, in which.

BEST MODE OF CARRYING OUT THE INVENTION

Figure 1:
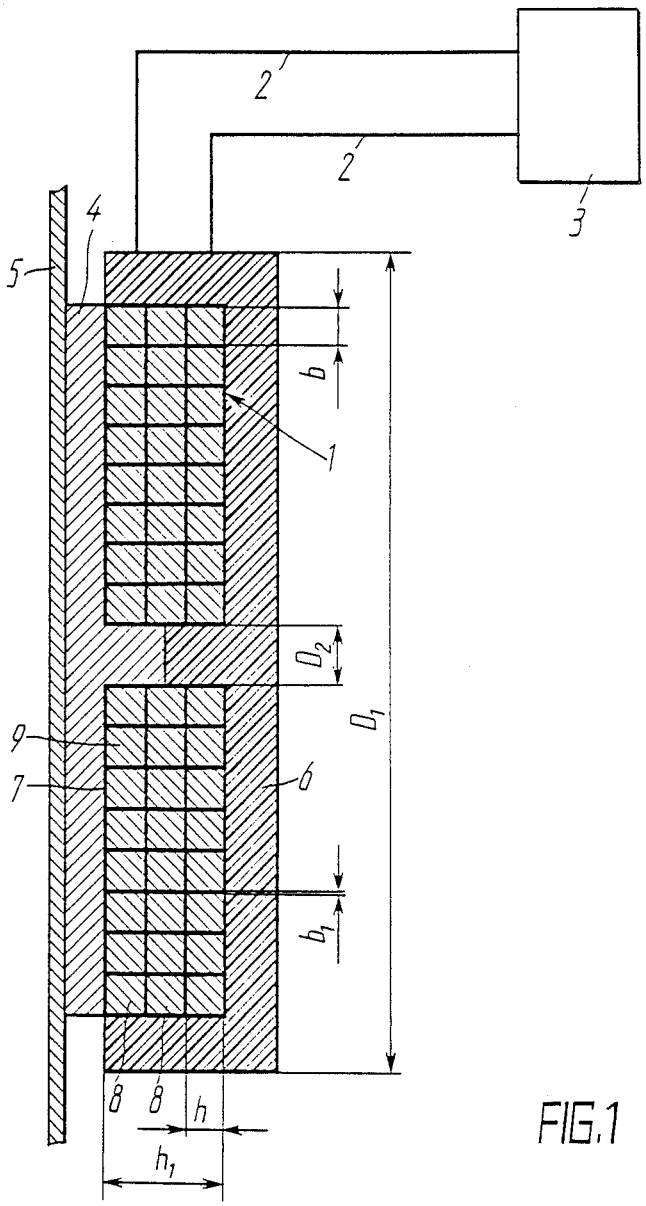
FIG. 1 is a longitudinal sectional view of an apparatus for cleaning surfaces from substances adhered thereto.

An apparatus for cleaning the workpiece surface from substances adhered thereto comprises an electromagnet coil 1 (FIG. 1) wired by current leads 2 to a source 3 of pulse current, and a paramagnetic plate 4 fabricated from a material of high electrical conductivity. The paramagnetic plate 4 is disposed between the surface 5 being cleaned and end face of the electromagnet coil 1. The electromagnet coil 1 is encapsulated in an epoxy compound 6 for extending the service life thereof.

The electromagnet coil 1 is fabricated from a copper current-conducting bar 7 of rectangular cross section having a heigh h and a width b. The electromagnet coil 1 is a multilayer coil with a number n of layers 8 equal to at least two, but not more than five. In this instance the number n of layers 8 is three. In each layer 8 the number W of coil turns 9 is nine. FIG. 1 shows dimensions of the electromagnet coil 1:

$D_1$, $D_2$—inside and outside diameters; b—width of the current conducting bar 7 of the layer 8; $b_1$—thickness of the insulation of the current conducting bar 7; h—height of the current conducting bar 7 of the layer 8; and $h_1$—height of the electromagnet coil 1.

The source 3 of pulse current can be of any known suitable design (cf., L. N. Karpenko "Bystrodeistvujuschie elektrodinamicheskie otkljuchajuschie ustroistva", published by the Energia Publishers, in Russian, 1973, Leningrad, pp. 31 to 35). Normally, for a two-layer electromagnet coil 1 the number W of coil turns 9 ranges from $0.4W_1$ to $1.1W_1$, whereas the height h of the current conducting bar 7 is within a range from Δ to 1,5Δ, where $W_1$—the optimum number of coil turns 9 in the layer 8 of the coil 1; and Δ the equivalent depth of magnetic field penetration into the metal of the electromagnet coil 1. For a three-layer electromagnet coil 1 the number W of coil turns 9 is within a range from $0.35W_1$ to $0.9W_1$, whereas the height h of the current conducting bar 7 ranges from 0.8Δ to Δ. For a four-layer electromagnet coil 1 the number W of coil turns 9 ranges from $0.32W_1$ to $0.75W_1$, the height h of the current conducting bar 7 ranging from 0.75Δ to 0.9Δ. For a five-layer electromagnet coil 1 the number W of coil turns 9 in each layer 8 is from $0.3W_1$ to $0.65W_1$, whereas the height h of the current conducting bar 7 ranges from 0.7Δ to 0.8Δ.

Figure 2:
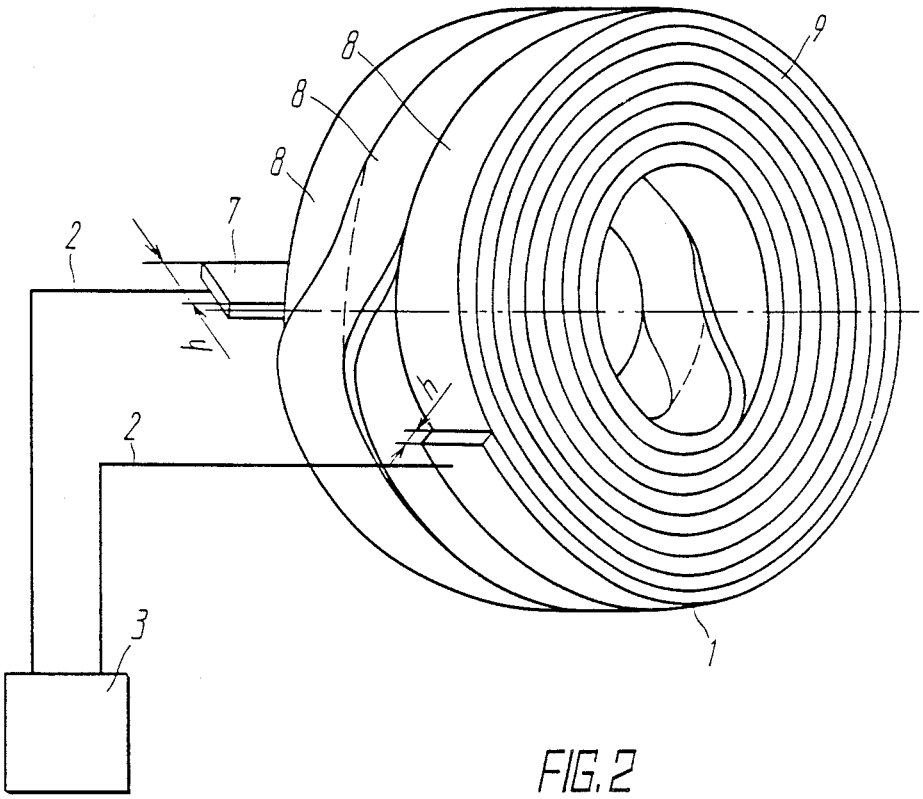
FIG. 2 shows a three-layer electromagnet coil connected to a source of pulse current.

FIG. 2 shows a three-layer electromagnet coil 1 connected to the source 3 of pulse current. The layers 8 of electromagnet coil 1 are arranged in parallel planes, and connected in an aiding, connection, whereas outlets of the current conducting bar 7 of the end layers 8 are connected by way of current leads 2 to the source 3 of pulse current.

Figure 3:
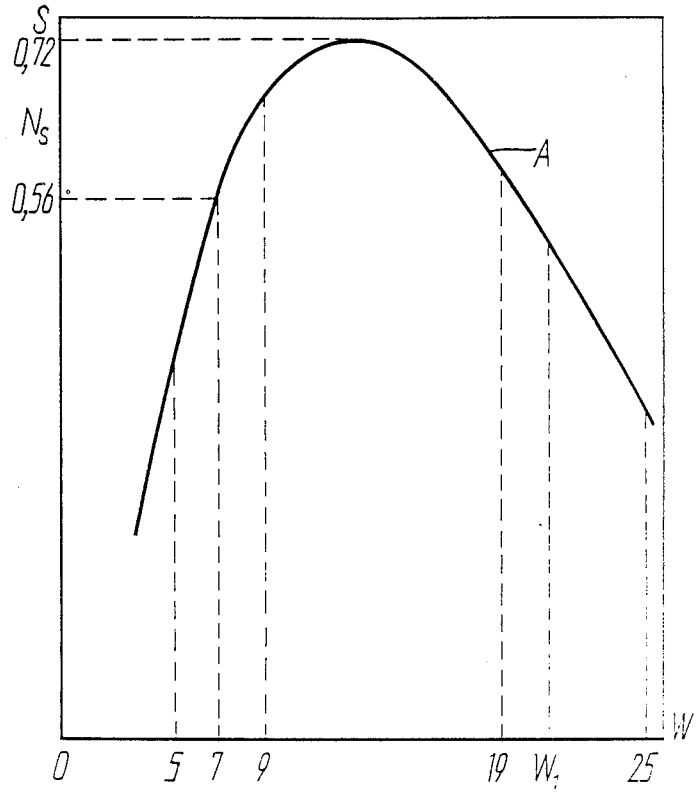
FIG. 3 shows a graph of dependence of and impulse S of force applied to the surface being cleaned on the number W of coil turns in the layer for a three-layer electromagnet coil.

In FIG. 3 curve A represents dependence of the impulse S of force on the number W of coil turns 9 in the layer 8 for a three-layer electromagnet coil 1 with $D_1=40$ mm and $D_2=10$ mm. The curve A shows the range of variations in the number W of coil turns 9 in the layer 8. In this case $0.35W_1 \leqq W \leqq 0.9W_1$, where $$W_1 = \frac{D_1 - D_2}{12b_1}. \quad (1)$$

Figure 4:
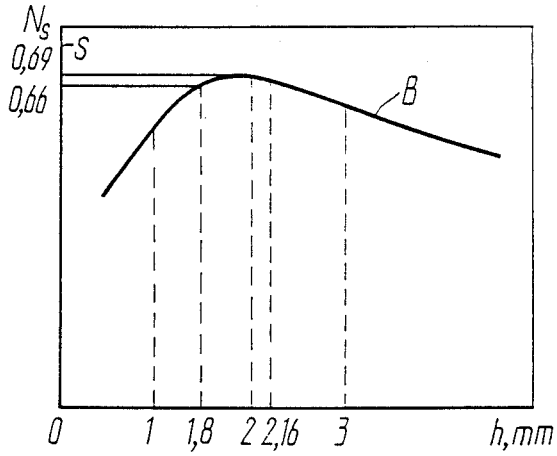
FIG. 4 shows a graph of dependence of an impulse S of force applied to the surface being cleaned on the height h of a current-conducting bar in an apparatus according to the invention.

Therefore, the number W of coil turns 9 will be within $7 \leqq W \leqq 19$. Within this range of variations in the number W of coil turns 9 in the layer 8 the impulse S of force arising between the coil 1 and paramagnetic plate 4 assumes the maximum magnitude from 0.56N·s to 0.72N·s. The magnitude of the impulse S of force for a three-layer electromagnet coil 1 having the number W of coil turns 9 in the layer 8 more than $0.9W_1$ or less than $0.35W_1$ becomes commensurable with the magnitude of the impulse S of force for a single-layer electromagnet coil 1 of the same size. The height h of the current conducting bar 7 of the electromgnet coil 1 is selected proceeding from the graph of dependence represented in FIG. 4. The curve B shows a dependence of the impulse S of force on the height h of the current conducting bar 7, this curve B showing also the range of variations in the height h. For a specific case, viz., at $n=3$, $D_1=40$ mm, $D_2=10$ mm, $W=9$, the height h of the current conducting bar 7 must be at least not less than or equal to 0.75Δ, and not more than or equal to 0.9Δ, or 1,8 mm $\leqq h \leqq 2.16$ mm, which corresponds to the impulse S of force ranging from 0.66N·s to 0.69N·s. The equivalent depth Δ of penetration of the magnetic field to the metal of electromagnet coil 1 is determined by the relationship:

$$\Delta = \left\{ \frac{2\,[c(L_1 - M^2/L_2)]^{\frac{1}{2}}]}{\mu_o \gamma} \right\}^{\frac{1}{2}}, \text{ where} \quad (2)$$

c—capacity of the source 3 of pulse current;

$L_1$—*inductance of the electromagnet coil* 1;

$L_2$—inductance of the paramagnetic plate 4;

M—mutual inductance of the system "electromagnet coil 1—paramagnetic plate 4";

γ—conductivity of the material of the electromagnet coil 1, and

μ—magnetic constant;

When the height h of the current conducting bar 7 is more than 0,9 Δ or less than 0.75Δ, the impulse S of force of a three-layer electromagnet coil 1 becomes commensurable with the impulse S of force of a single-layer electromagnet coil 1 of the same size.

The apparatus for cleaning the surface 5 (FIG. 1) from substances adhered thereto operates in the following manner. As a current pulse is applied successively to each layer 8 of the electromagnet coil 1 having the number W of coil turns 9 equal in this specific instance to nine and the height h of the current conducting bar 7 equal to 2 mm by way of the current lead 2 from the source 3 of pulse current, a pulsed magnetic field is established about the three-layer electromagnet coil 1, and eddy currents are induced in the paramagnetic plate 4. Interaction of the pulsed magnetic field with the eddy currents generates an impulse S of force acting on the paramagnetic plate 4 and transmitted to the surface 5 being cleaned. This gives rise to elastic vibrations in the surface 5 being cleaned, whereby the surface 5 is cleaned of the substance adhered thereto. A higher cleaning efficiency is attained with an increase in the impulse S of force acting on the surface 5 due to the growing forces imparted to the substance adhered to the surface. The magnitude of the impulse S of force depends on the parameters of the electromagnet coil 1 and its structural arrangement.

Arrangement of each layer 8 of the electromagnet coil 1 in the form of a helical current conducting bar 7 of rectangular cross section ensures flat end surface of the electromagnet coil 1 with a minimum clearance between the electromagnet coil 1 and paramagnetic plate 4, and increases the space factor K of the winding of the electromagnet coil 1. The space factor K is determined from the expression:

$$K = \frac{2n\,W \cdot h \cdot b}{(D_1 - D_2) \cdot h_1}, \text{ where} \quad (3)$$

n—number of layers 8;

W—number coil turns 9 in the layer 8;

h, b—height and width of the current conducting bar 7, respectively;

$D_1$, $D_2$—inside and outside diameters of the electromagnet coil 1; and $h_1$—height of the electromagnet coil 1.

An increase in the space factor K of the winding of the electromagnet coil 1 in turn makes it possible to reduce magnetic leakage and increase the magnetic field strength at the end face of the electromagnet coil 1. Since the magnetic pressure exerted on the paramagnetic plate 4 equals in magnitude to the space density of the energy of the magnetic field, the impulse S of force tends to grow resulting in more efficient cleaning of the surface.

Thanks to the aiding connection of the layers 8 of the coil (FIG. 2) the total magnetic flus and intensity of magnetic field at the end face of the electromagnet coil 1 are increased, whereas the arrangement of the layers 8 in parallel planes ensures uniform magnetic pressure exerted on the paramagnetic plate 4 in the axial direction to result in a more efficient conversion of the energy of the source 3 of pulse current and higher efficiency of surface cleaning. The multilayer arrangement of the electromagnet coil 1 with the number n of layers 8 ranging from two to five provides the most efficient conversion of the energy of the source 3 of pulse current into mechanical energy for cleaning the surface 5 (FIG. 1) thanks to a more pronounced impulse S of force applied to the surface 5 being cleaned. In this case an impulse S of force of a magnitude 20 to 35% higher than that produced by a single-layer electromagnet coil 1 is imparted to the surface 5 being cleaned. This has been attained by increasing the inductance and improving the quality of the multi-layer electromagnet coil 1 as compared with a single-layer electromagnet coil 1. With an increase in the number n of layers 8 to over five the magnitude of the force pulse S is reduced due to weakened electromagnetic coupling of the most remote layers 8 of the electromagnet coil 1 with the paramagnetic plate 4 to become commensurable with the magnitude of the impulse S of force generated by the single-layer electromagnet coil 1.

The preferred number W of coil turns 9 in each layer 8 of the electromagnet coil 1 is the following: for a two-layer electromagnet coil 1 the number of coil turns is more than or equal to $0.4W_1$ and less than or equal to $1.W_1$; for a three-layer electromagnet coil 1 it is more than or equal to $0.32W_1$ and less than or equal to $0.9W_1$; for a four-layer electromagnet coil 1 it is more than or equal to $0.32W_1$ and less than or equal to $0.75W_1$; for a five-layer electromagnet coil 1 it is more than or equal to $0.3W_1$ and less than or equal to $0.65W_1$, where $W_1$ is the optimum number of coil turns 9 in the layer 8 obtained in the case of absence of spurious inductance and parasitic resistance in the source 3 of pulse current and current lead 2, and without taking into account the effect of resistance of the paramagnetic plate 4.

If the number W of turns 9 in the layer 8 for a two-layer electromagnet coil 1 is less than $0.4W_1$, for a three-layer electromagnet coil 1 less than $0.35W_1$, for a four-layer electromagnet coil 1 less than $0.32W_1$, and for a five-layer electromagnet coil 1 is less than $0.3W_1$, the impulse S of force acting on the paramagnetic plate 4 is reduced. This occurs due to a reduction in the magnitude of the inductance $L_1$ of the electromagnet coil 1 and mutual inductance M between the electromagnet coil 1 and paramagnetic plate 4. An increase in the number W of coil turns 9 in the layer 8 for a two-layer electromagnet coil 1 to over $1.1W_1$, for a three-layer electromagnet coil 1 to over $0.9W_1$, for-layer electromagnet coil 1 to over $0.75W_1$, and for a five-layer electromagnet coil 1 to over $0.65W_1$ results in a growing inductance $L_1$ of the electromagnet coil 1 and mutual inductance M. However, this produces a detrimental effect associated with losses of energy at the active resistance of electromagnet coil 1, whereby the impulse S of force is reduced accompanied by a reduction in the efficiency of operation of the proposed apparatus, and consequently less efficient surface cleaning.

The height h of the current conducting bar 7 is selected from within the following range: for a two-layer electromagnet coil 1 it is greater than or equal to Δ and smaller than or equal to 1.5Δ; for a three-layer electromagnet coil 1 it is greater than or equal to 0.8Δ and less than or equal to Δ; for a four-layer electromagnet coil 1 it is greater than or equal to 0.75Δ and smaller than or equal to 0.9Δ; for a five-layer electromagnet coil 1 it is greater than or equal to 0.7Δ and smaller than or equal to 0.8Δ, where Δ is the equivalent depth of penetration of the megnetic field into the metal of electromagnet coil 1. At the height h of the current conducting bar 7 for a two-layer electromagnet coil 1 of less then Δ, for a three-layer electromagnet coil less than 0.8Δ, for a four-layer electromagnet coil 1 less than 0.75Δ, and for a five-layer electromagnet coil 1 less than 0.7Δ the resistance of the elctromagnet coil 1 is increased accompanied by a reduction in quality. This in turn leads to more substantial losses of energy at the resistance and impaired impulse S of force (cf., curve B in FIG. 4). An increase in the height h of the current conducting bar 7 (FIG. 1) for a two layer electromagnet coil to more than 1.5Δ, for a three-layer electromagnet coil to more than Δ, for a four-layer electromagnet coil 1 to more than 0.9Δ, for a five-layer electromagnet coil 1 to more than 0.7Δ results in weakening of electromagnetic coupling between the layers 8 (FIG. 1) of the electromagnet coil 1 and paramagnetic plate 4 (cf., curve B in FIG. 4). This occurs due to an increasing gap between the second, third, fourth, fifth layer 8 (FIG. 1) and paramagnetic plate 4 resulting in a reduction in the impulse S of force (cf., curve B in FIG. 4).

In view of the aforedescribed, the proposed apparatus for cleaning a surface from substances adhered thereto makes it possible, by virtue of enhancing the impulse S of force applied to the surface 5 (FIG. 1) being cleaned, to increase the efficiency of converting the energy of the source 3 of pulse current to mechanical energy used for cleaning the surface 5, and thereby attain a higher surface cleaning efficiency.

INDUSTRIAL APPLICABILITY

The invention can be used for cleaning the walls of hoppers, dryers, cyclones, pipes and other similar equipment from substances tending to adhere thereto, bridging of loose materials, ice and other contaminants.

We claim:

1. An apparatus for cleaning surface from substances adhered thereto comprising an electromagnet coil (1), a source (3) of pulse current connected to the electromagnet coil (1), a paramagnetic plate (4) from a highly electroconductive material arranged between the surface (5) being cleaned and end face of the electromagnet coil (1), characterized in that the electromagnet coil (1) is multilayer, the number n of layers (8) ranging from two to five, each layer (8) having the form of a helical current conducting bar (7) of rectangular cross section, the layers (8) of the electromagnet coil (1) resting in parallel planes and connected in an aiding connection, the number W of coil turns (9) in each layer (8) for a two-layer electromagnet coil (1) ranging from $0.4W_1$ to $1.1W_1$, whereas the height h of the current-conducting bar (7) ranges from $\Delta$ to $1.5\Delta$, for a three-layer electromagnet coil (1) the number W of coils (9) in each layer (8) ranging from $0.35W_1$ to $0.9W_1$, whereas the height h of the current-conducting bar (7) ranges within from $0.8\Delta$ to $\Delta$, for a four-layer electromagnet coil (1) the number W of turns (9) in each layer (8) ranging from $0.32W_1$ to $0.75W_1$, whereas the height h of the current-conducting bar (7) ranges from $0.75\ \Delta$ to $0.9\ \Delta$, and for a five-layer electromagnet coil (1) the number W of turns (9) in each layer (8) ranging from $0.3W_1$ to $0.65W_1$, whereas the height h of the current-conducting bar (7) is within a range from $0.7\Delta$ to $0.8\ \Delta$, where $W_1$ is the optimum number of turns (9), and $\Delta$ is the equivalent depth of penetration of the magnetic field into the metal of the electromagnet coil (1).

* * * * *

UNITED STATES PATENT AND TRADEMARK OFFICE

CERTIFICATE OF CORRECTION

PATENT NO. : 4,985,735

DATED : January 15, 1991

INVENTOR(S) : ALEXANDR P. ODNORAL

It is certified that error appears in the above-identified patent and that said Letters Patent is hereby corrected as shown below:

Title page, left column, Item "[54]", "Electric Drive With Manual Doubler" should be -- Apparatus For Cleaning A Surface From Substances Adhered Thereto --.

Title page, left column, before "[21]", insert --[73] Assignee: Filial Vsesojuznogo Electrotekhnicheskogo Instituta Imeni V.I. Lenina--.

Title page, right column, "Burgess, Ryan & Wayne" should be -- Ladas & Parry --.

Signed and Sealed this

Twenty-eighth Day of April, 1992

*Attest:*

HARRY F. MANBECK, JR.

*Attesting Officer*

*Commissioner of Patents and Trademarks*